US009741514B2

(12) United States Patent
Cernat et al.

(10) Patent No.: US 9,741,514 B2
(45) Date of Patent: Aug. 22, 2017

(54) SWITCHING ARRANGEMENT

(71) Applicant: SIEMENS AKTIENGESELLSCHAFT, Munich (DE)

(72) Inventors: Radu-Marian Cernat, Berlin (DE); Martin Krehnke, Berlin (DE); Volker Lehmann, Treuenbrietzen (DE); Friedrich Loebner, Berlin (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/762,551

(22) PCT Filed: Jan. 7, 2014

(86) PCT No.: PCT/EP2014/050133

§ 371 (c)(1),
(2) Date: Jul. 22, 2015

(87) PCT Pub. No.: WO2014/114483

PCT Pub. Date: Jul. 31, 2014

(65) Prior Publication Data

US 2015/0371797 A1 Dec. 24, 2015

(30) Foreign Application Priority Data

Jan. 22, 2013 (DE) ..... 10 2013 200 913

(51) Int. Cl.

| | |
|---|---|
| ***H01H 33/70*** | (2006.01) |
| ***H01H 33/02*** | (2006.01) |
| ***H01H 1/38*** | (2006.01) |

(52) U.S. Cl.

CPC ..... *H01H 33/7023* (2013.01); *H01H 1/385* (2013.01); *H01H 2033/028* (2013.01)

(58) Field of Classification Search

CPC .. H01H 33/02; H01H 33/7023; H01H 33/901; H01H 33/904; H01H 33/91;

(Continued)

(56) References Cited

U.S. PATENT DOCUMENTS

| | | | |
|---|---|---|---|
| 3,551,624 | A | 12/1970 | Fischer |
| 5,578,806 | A | 11/1996 | Hofbauer et al. |

(Continued)

FOREIGN PATENT DOCUMENTS

| | | | |
|---|---|---|---|
| CN | 1128892 | A | 8/1996 |
| CN | 1357901 | A | 7/2002 |

(Continued)

OTHER PUBLICATIONS

Translation of EP0809269 (orig. doc. published Nov. 26, 1997).*

*Primary Examiner* — Renee S Luebke
*Assistant Examiner* — William Bolton
(74) *Attorney, Agent, or Firm* — Laurence Greenberg; Werner Stemer; Ralph Locher

(57) ABSTRACT

A switching arrangement has a first contact set and a second contact set which can be moved with respect to the first contact set, and an insulating nozzle arrangement. The insulating nozzle arrangement is supported on the first contact set which includes a first arcing contact piece. The first arcing contact piece can be moved with respect to the insulating nozzle arrangement.

12 Claims, 8 Drawing Sheets

(58) Field of Classification Search
CPC ..... H01H 33/78; H01H 2033/028; H01H 2033/908; H01H 1/385; H01H 33/123; H01H 33/06; H01H 33/245; H01H 33/42
USPC ..... 218/53, 56, 57, 59, 63, 72
See application file for complete search history.

(56) References Cited

U.S. PATENT DOCUMENTS

| | | | | |
|---|---|---|---|---|
| 6,365,863 | B1 * | 4/2002 | Marin | H01H 33/42 218/43 |
| 6,429,394 | B2 | 8/2002 | Hunger et al. | |
| 7,679,021 | B2 * | 3/2010 | Gericke | H01H 11/041 218/48 |
| 8,013,268 | B2 * | 9/2011 | Ozil | H01H 33/904 218/155 |
| 2009/0090697 | A1 * | 4/2009 | Dufournet | H01H 33/905 218/116 |
| 2010/0163527 | A1 * | 7/2010 | Yoon | H01H 33/904 218/62 |

FOREIGN PATENT DOCUMENTS

| | | | | |
|---|---|---|---|---|
| DE | 2336684 | A1 | 1/1975 | |
| DE | 19622460 | A1 | 11/1997 | |
| DE | 10006167 | A1 | 9/2001 | |
| EP | 0483840 | A2 | 5/1992 | |
| EP | 0809269 | * | 11/1997 | H01H 33/91 |
| EP | 1211706 | A1 | 6/2002 | |
| EP | 2343720 | A1 | 7/2011 | |
| KR | 20070008041 | A | 1/2007 | |
| SU | 1026184 | A1 | 6/1983 | |

* cited by examiner

SWITCHING ARRANGEMENT

BACKGROUND OF THE INVENTION

Field of the Invention

The invention relates to a switching arrangement comprising a first contact set and a second contact set, which can be moved relative to the first contact set, and also comprising an insulating nozzle arrangement supported on the first contact set, wherein the first contact set has a first arcing contact piece.

The switching arrangement known from U.S. Pat. No. 5,578,806 has a first and also a second contact set, wherein an insulating nozzle arrangement is supported on the first contact set. The first contact set is equipped with an arcing contact piece, which is used to guide a switching arc. The insulating nozzle arrangement steers and directs a burning switching arc and also a gas expanded by the switching arc. A switching arc has a thermal influence on its surrounding environment. Accordingly, the first arcing contact piece and the insulating nozzle arrangement are to be configured in such a way that they have a sufficient resistive force to be able to repeatedly steer, direct and guide switching arcs. Despite a suitable design of the first arcing contact piece and of the insulating nozzle arrangements, signs of burn-up appear. As a result, known switching arrangements are to be regularly checked. Furthermore, super elevations of the electric field occur in the region of the insulating nozzle arrangement and lead to additional loading.

The object is therefore to specify a switching arrangement of which the modules are stressed to a lower extent.

BRIEF SUMMARY OF THE INVENTION

The object is achieved in accordance with the invention in the case of a switching arrangement of the type mentioned in the introduction in that the first arcing contact piece can be moved relative to the insulating nozzle arrangement.

A switching arrangement comprising a first contact set and a second contact set is designed to interrupt a current path. For this purpose, the two contact sets can be moved relative to one another, such that in the switched-on state there is galvanic contact of the two contact sets, whereas in the switched-off state the two contact sets are distanced in an electrically insulated manner. What is known as a switching arc may be ignited between the two contact sets as the switching arrangement is transferred from its switched-on state into its switched-off state. In particular, the first contact set may have a first arcing contact piece, which is designed in such a way that it has an increased resistance to the effects of a switching arc. In particular, the first arcing contact piece is used to guide a root of the switching arc, such that the first arcing contact piece on the one hand must be able to convey an electrical current and on the other hand must have sufficient burn-up resistance.

The first arcing contact piece interacts during a switching procedure with the insulating nozzle arrangement, wherein the insulating nozzle arrangement preferably surrounds a switching arc, which is guided at the first arcing contact piece, and directs said switching arc in a nozzle channel. It is thus possible to limit any bulging of the switching arc. In particular, a switching chamber may be arranged between the two contact sets, in which chamber the burning of a switching arc should preferably take place. The insulating nozzle arrangement may protrude here into a switching chamber of this type. The insulating nozzle arrangement may also delimit parts of the switching chamber or divide the switching chamber into different zones. By way of example, the insulating nozzle may penetrate the switching chamber and enable communication of a fluid between the first contact set and the second contact set via a nozzle channel. By way of example the switching arrangement, in particular the switching chamber and also the contact sets may be flushed by an electrically insulating fluid, which is used on the one hand to electrically insulate elements conveying different electric potentials, but on the other hand can also be used for cooling or blowing and lastly extinguishing a switching arc. By way of example the electrically insulating fluid may be an insulating oil or also an insulating gas, for example sulfur hexafluoride, nitrogen, carbon dioxide or mixtures containing these gases. A movement of the first arcing contact piece relative to the insulating nozzle arrangement makes it possible to positively influence the insulation in the region of the switching chamber. By way of example an enlarged gap, which can be filled with fluid, may be arranged between the insulating nozzle arrangement and the first arcing contact piece in the switched-off state by a movement of the arcing contact piece relative to the insulating nozzle. Within this area it is possible to collect electrically insulating fluid, such that the dielectric strength at the first arcing contact piece is increased by arranging there an enlarged volume of electrically insulating fluid. It is also advantageous when the first arcing contact piece, for example during the guidance and steering of an arc, is positioned particularly close to the insulating nozzle arrangement, such that the switching arc is prevented from breaking out in cooperation with the insulating nozzle arrangement. By bringing the first arcing contact piece toward the insulating nozzle arrangement the path length provided for a burning switching arc is thus reduced and a breakout of the switching arc from the switching chamber, in particular from a nozzle channel of the insulating nozzle arrangement, is hindered. The insulating nozzle arrangement may have, for example, a main nozzle and an auxiliary nozzle, which together delimit a nozzle channel. Here, the main nozzle and the insulating nozzle overlap one another in part, such that an annular gap is formed between the main nozzle and auxiliary nozzle, which gap leads into the nozzle channel from a radial direction. It is thus possible to form a radial mouth opening in the nozzle channel and to direct, for example, hot switching gases out from this radial mouth opening. By way of example it is thus possible to relieve the pressure in the nozzle channel of the insulating nozzle arrangement.

Furthermore, the radial mouth opening in the nozzle channel can be used to bring heated insulating gas (switching gas) of enlarged volume into what as known as a heating volume, to buffer said gas and to discharge this later from the heating volume, where necessary, in order to promote a rapid reinforcement of the clearance between open contacts between the contact sets. A heating volume should be arranged in a stationary manner on the first contact set. Accordingly, a stationary position of the heating volume with respect to the insulating nozzle arrangement is also provided. The heating volume can be penetrated for example by the first arcing contact piece. The heating volume may preferably have a rotationally symmetrical form, which is penetrated centrally by the first arcing contact piece. The heating volume can be surrounded externally on the circumferential side by a first nominal current contact piece. The first arcing contact piece can be moved relative to the heating volume.

In particular, the insulating nozzle arrangement may have a substantially rotationally symmetrical structure, wherein the nozzle channel delimited by the insulating nozzle arrangement is oriented coaxially with the axis of rotation. Accordingly, both the main nozzle and the auxiliary nozzle should each be rotationally symmetrical, wherein the main nozzle and auxiliary nozzle overlap one another in the radial direction by being inserted one inside the other, such that for example a mouth opening is created in the nozzle channel between the main nozzle and auxiliary nozzle, which mouth opening lies in the radial direction in the nozzle channel.

The insulating nozzle arrangement can be connected at a fixed angle to the first contact set. The insulating nozzle arrangement may be carried at least in part, particularly completely, by the first contact set. The first contact set can be formed in a number of parts, such that the first arcing contact piece can be moved relative to the insulating nozzle arrangement. The insulating nozzle arrangement may also rest slidingly on the second contact set. For this purpose, the insulating nozzle arrangement may penetrate the switching chamber, such that the first and the second contact side are electrically insulated from one another and a mechanical bridge between the contact sides located in the separated position is formed by the insulating nozzle arrangement.

The first arcing contact piece may be surrounded at least in part by the insulating nozzle arrangement. By way of example the insulating nozzle arrangement may have a recess, into which the first arcing contact piece protrudes. The first arcing contact piece may protrude into the recess for example with a complementary shape. Furthermore, the insertion depth of the first arcing contact piece into the recess in the insulating nozzle arrangement can be varied by means of a relative movement between insulating nozzle arrangement and first arcing contact piece. The first arcing contact piece for example may protrude into the nozzle channel, in particular into a portion of the nozzle channel having an enlarged cross section. Furthermore, the nozzle channel may lead into a recess in the nozzle arrangement, wherein the first arcing contact piece protrudes into the recess, in particular with a complementary shape. During the course of a relative movement, the distance between the arcing contact piece protruding into the recess and the mouth opening of the nozzle channel in the recess may vary.

Furthermore, the insulating nozzle arrangement may advantageously delimit a nozzle channel which has a mouth opening arranged opposite a mouth opening of a channel of the first arcing contact piece.

In the case of a rotationally symmetrical insulating nozzle arrangement, the nozzle channel of the insulating nozzle arrangement extends preferably coaxially with the axis of rotation of the insulating nozzle arrangement. The nozzle channel should preferably be guided centrally in the insulating nozzle arrangement. The nozzle channel has mouth openings at each end, wherein in particular an end mouth opening of the nozzle channel is arranged opposite a mouth opening of a channel of the first arcing contact piece. By way of example it is thus possible for media exiting the nozzle channel to enter the channel of the first arcing contact piece. By way of example it is thus possible to send switching gases heated via the contact region of the first arcing contact piece, which contact region is formed from a material that is preferably resistant to burn-up, into the first arcing contact piece and to use the first arcing contact piece to direct hot switching gases out from the switching chamber. By way of example the first arcing contact piece can be shaped in the form of what is known as a pipe contact piece, such that an elongated channel is formed at the first arcing contact piece, said channel preferably being aligned with the nozzle channel of the insulating nozzle arrangement. Particularly with a socket-shaped embodiment of the contact region of the first arcing contact piece, the socket-shaped contact region can be used as a mouth opening of the channel. The socket-shaped contact region can be surrounded on the outer circumferential side by the insulating nozzle arrangement, such that a low-loss transfer of the media exiting from the nozzle channel into the channel of the first arcing contact piece is provided. The nozzle channel may lead for example into a recess of the nozzle arrangement, wherein the first arcing contact piece protrudes with a complementary shape into the recess. The recess can be radially widened with respect to the cross section of the mouth opening of the nozzle channel. A shoulder running around the mouth opening thus provides space for receiving a wall encircling the mouth opening of the channel of the first arcing contact piece. A movement of the first arcing contact piece relative to the insulating nozzle arrangement can be provided here preferably in such a way that the mouth openings, which face toward one another, of the nozzle channel or of the channel of the first arcing contact piece are brought toward one another or moved away from one another. The mouth openings should be arranged here substantially transversely to a movement axis of the relative movement between first arcing contact piece and insulating nozzle arrangement. The cross sections of the mouth openings should preferably be aligned similarly. It is thus possible accordingly, at the start of a switch-off procedure, to keep the distance between the mouth openings as small as possible. Here, the mouth openings may contact one another, such that a practically gap-free transition from the nozzle channel to the channel of the first arcing contact piece is provided. However, it may also be that a gap still remains between the mouth openings of the nozzle channel and also the channel of the first arcing contact piece, even with minimal distancing, which gap is filled by electrically insulating fluid. This distancing is advantageous in order to maintain the insulation. By way of example it is thus possible for an electrically insulated region to be formed even in the case of burn-up of the regions on the insulating nozzle arrangement or on the first arcing contact piece surrounding the mouth openings, which electrically insulated region also acts in a self-repairing/self-adapting manner on account of the fluid embodiment. Compared with a contacting of undefined burned-up surfaces, a dielectrically stable construction is thus provided. Here, in the switched-on state, the mouth openings of the insulating nozzle channel and the channel in the first arcing contact piece may be distanced minimally in particular. The gap remaining between the mouth openings can be surrounded on the outer circumferential side by the insulating nozzle arrangement. Irrespective of the width of the gap, this gap may always be surrounded by the insulating nozzle arrangement. A radial evaporation of switching gas exiting from the nozzle channel is thus counteracted. The first arcing contact piece can be surrounded for example by a protrusion of the first arcing contact piece into a recess in the insulating nozzle arrangement. Irrespective of the dimension of the gap between the mouth openings facing toward one another, the first arcing contact piece should remain permanently in the recess. The insertion depth of the first arcing contact piece in the recess may vary in a manner corresponding to the change of the gap.

An enlargement of the distancing of the mouth openings should be provided prior to a moment at which a switching arc has already been extinguished. In particular, the first arcing contact piece should cooperate with a second arcing contact piece of the second contact set. During the period of contact between the two the arcing contact pieces, the mouth openings, which face toward one another, of the insulating nozzle channel and the channel of the first arcing contact piece are brought toward one another, leaving free a small gap. With/after a galvanic separation of the arcing contact pieces and a switching arc possibly already burning at this moment in time, the distancing of the mouth openings of the nozzle channel and of the channel of the first arcing contact piece is preferably enlarged. With an additional distancing or additional movement of the first arcing contact piece relative to the insulating nozzle arrangement, there is an additional enlargement of the insulation path between the two contact sets. At the same time, a cushion of electrically insulating fluid is built up between the insulating nozzle arrangement and the first arcing contact piece in the enlarging gap between the mouth openings facing toward one another and additionally acts in a cooling manner on the arc. It is also advantageous when the first arcing contact piece is driven into the field shadow of a shielding element. A shielding element of this type for example may be a separate field control electrode. However, the first arcing contact piece may also be assigned a first nominal current contact piece, which surrounds the first arcing contact piece at least in part. With a relative movement between the first arcing contact piece and insulating nozzle arrangement, the first arcing contact piece can be driven in a targeted manner into the shield region of the shielding element. A re-ignition of the arc once extinguished is thus hindered, since field strength super elevations at the first arcing contact piece are now abolished in the field shadow by the electrical shield effect.

Furthermore, the nozzle channel may advantageously serve to convey a fluid medium, and fluid medium exiting from the mouth opening of the nozzle channel may advantageously flow into the channel.

A switching arc burning between the contact sets heats and expands electrically insulating fluid located within the switching chamber between the contact sets. The temperature of the electrically insulating fluid rises on account of the thermal effect, and the volume of said fluid increases. In order to counteract an explosion of the switching arrangement, it is advantageous to guide this 'switching gas' (fluid medium) out from the clearance between open contacts between the contact sets and to relieve this gas of pressure. Here, the switching gas is discharged and advantageously guided into uncritical areas of the switching arrangement, in which the switching gas can be mixed for example with cooler gas and can be relieved of pressure. A passing of a fluid medium from the nozzle channel into the channel of the first arcing contact piece uses the shaping of the first contact set in order to also convey and guide fluid, in addition to electrically conducting the current. The distance between the mouth openings of the nozzle channel and also the channel of the first arcing contact piece can be varied by a movement of the first arcing contact piece relative to the insulating nozzle arrangement. By way of example, with the occurrence of high switching gas quantities (for example at the start of a switch-off procedure), the distancing of the mouth openings can be reduced, whereas with reducing switching gas quantities (for example the end of a switch-off procedure, an enlarged distancing of the mouth openings can be provided. Furthermore, a rapid dielectric reinforcement of the clearance between open contacts between the contact sets can be assisted by a dielectric shielding of the contact region of the first arcing contact piece, such that an undesirable re-ignition of a switching arc during a switch-off procedure is counteracted.

In accordance with a further advantageous embodiment the channel is surrounded at least in portions by a contact socket of the first arcing contact piece.

The first arcing contact piece for example may have a contact socket, into which a second arcing contact piece of the second contact set formed in a mirror-inverted manner can be driven. Two arcing contact pieces can thus be galvanically contacted in a simple manner. On the other hand, the contact socket can also be used to provide a mouth opening for a channel in the first arcing contact piece. A fluid medium exiting from the nozzle channel can thus enter the channel of the first arcing contact piece via the contact socket. The contact socket may be surrounded by the insulating nozzle arrangement in order to ensure that switching gas passes from the nozzle channel into the channel of the first arcing contact piece with as little loss as possible.

In accordance with a further advantageous embodiment the first contact set may have a first nominal current contact piece, which carries the insulating nozzle arrangement at least in part.

Providing the first contact set with a first nominal current contact piece makes it possible to use the first arcing contact piece at the first contact set in order to guide an arc, whereas the first nominal current contact piece is used to guide a nominal current. Accordingly, the first nominal current contact piece can be optimized in terms of its electrical impedance, whereas the first arcing contact piece can be optimized in terms of its resistance to the effects of a switching arc. The first arcing contact piece should be movable relative to the first nominal current contact piece. By way of example the first arcing contact piece and the first nominal current contact piece may permanently guide the same potential, wherein, in the event of a switch-off procedure, a galvanic connection between the first nominal current contact piece and for example a second nominal current contact piece of the second contact set is firstly cancelled, wherein the first arcing contact piece is then galvanically separated, where applicable, from a second arcing contact piece of the second contact set. An electrical current to be interrupted can be commutated accordingly from the nominal current contact pieces to the arcing contact pieces, where it can flow in the form of a switching arc following galvanic separation. This switching arc is to be interrupted during a switching procedure, such that an electrical current can be switched off ultimately. Conversely, in the event of a switch-on procedure, the arcing contact pieces are firstly contacted, and the nominal current contact pieces are then contacted. Preliminary flashovers occurring during a switch-on procedure are thus also preferably guided at the arcing contact pieces.

The first nominal current contact piece may carry the insulating nozzle arrangement at least in part. A bond between the first nominal current contact piece and the insulating nozzle arrangement should preferably be formed at a fixed angle, such that movements of the first nominal current contact piece are also transmitted to the insulating nozzle arrangement (and vice versa). The first nominal current contact piece should preferably be formed in the manner of a pipe contact, wherein the insulating nozzle arrangement should be fastened preferably on the inner circumferential side, i.e. in a dielectrically shielded region of a tubular first nominal current contact piece. The first nominal current contact piece should preferably be formed for this purpose as a rotationally symmetrical body, of which the axis of rotation is arranged coaxially with a substantially rotationally symmetrical insulating nozzle arrangement. The first arcing contact piece should preferably be designed in a tubular manner, surrounded by the first nominal current contact piece, and should be arranged coaxially with the axis of rotation of the insulating nozzle arrangement and of the first nominal current contact piece. In the region of a contact socket of the first arcing contact piece, the first arcing contact piece should preferably be surrounded on the outer circumferential side by the insulating nozzle arrangement, wherein the insulating nozzle arrangement in turn should be surrounded in this region on the outer circumferential side by the first nominal current contact piece. Accordingly, the first nominal current contact piece, which is formed from an electrically conductive material, may provide a dielectric shielding of the first arcing contact piece and also of parts of the insulating nozzle arrangement located in the field shadow. In particular with a movement of the first arcing contact piece relative to the first nominal current contact piece, preferably along an axis of rotation, the first arcing contact piece can be moved into the dielectrically shielding region of the first nominal current contact piece (switch-off procedure) or can be moved out from the shielding region (switch-on procedure). In particular during a switch-off procedure, the first arcing contact piece can be shifted in a manner distanced from the insulating nozzle arrangement into the field shadow of the first nominal current contact piece. During a switch-off procedure, a potentially burning switching arc is thus extended, and an extinguishing thereof is assisted. On the other hand, the contact region of the arcing contact piece is shifted into a dielectrically shielded region, such that, following an extinguishing of the switching arc, a re-ignition of a switching arc is hindered on account of the dielectrically advantageous conditions within the first nominal current contact piece.

Forming an insulating nozzle arrangement with a main nozzle and an auxiliary nozzle also has the advantage that the insulating nozzle arrangement can be formed in a modular manner as necessary. On the other hand, the delimitation of the nozzle channel by main nozzle and auxiliary nozzle provides the possibility to allow a distancing between the main nozzle and the auxiliary nozzle, for example in the region of a joining gap there between, such that a radial mouth opening is provided at the nozzle channel. By way of example, excess fluid components of a fluid medium, which for example are not intended to flow into the channel of the first arcing contact piece, can be left out from the nozzle channel via this radial mouth opening.

In accordance with a further advantageous embodiment the first arcing contact piece may be surrounded by the first nominal current contact piece at least in portions.

The first nominal current contact piece may surround the first arcing contact piece at least in portions. It is thus possible to protect the first arcing contact piece mechanically, but particularly dielectrically, by the first nominal current contact piece. Here, the first arcing contact piece may extend for example at least in portions within the first nominal current contact piece, such that no additional shielding measures are necessary for the first arcing contact piece. In particular in the switched-off state, the contact region of the first arcing contact piece should be surrounded completely and dielectrically shielded by the first nominal current contact piece.

In accordance with a further advantageous embodiment the first arcing contact piece and the first nominal current contact piece can be mounted so as to be movable relative to one another.

A relative movability between first arcing contact piece and first nominal current contact piece, in particular in the direction of an axis of rotation of the first arcing contact piece, makes it possible to bring the arcing contact piece as necessary, in particular in the switched-off state, into a space dielectrically shielded by the first nominal current contact piece. On the one hand the risk of a re-ignition of an extinguished switching arc is thus reduced. On the other hand the clearance between open contacts between the two contact sides is enlarged and this clearance between open contacts can be filled with an electrically insulating fluid. A separation of electric potentials is thus improved, such that greater voltages and also greater currents can also be safely handled by the switching device arrangement. Besides a movement of the first arcing contact piece and also of the first nominal current contact piece relative to one another, a movement of the first arcing contact piece relative to the insulating nozzle arrangement is also performed. Here, the insulating nozzle arrangement should preferably remain positioned in a stationary manner relative to the first nominal current contact piece.

The second contact set may also advantageously have a second nominal current contact piece and a second arcing contact piece, wherein each of the two arcing contact pieces can be moved relative to each of the two nominal current contact pieces in order to produce a relative movement of the contact pieces.

The use of a first nominal current contact piece and also of a first arcing contact piece at the first contact set advantageously results in the utilization of a second arcing contact piece and also of a second nominal current contact piece at the second contact set. Here, the first contact pieces and the second contact pieces can be formed in a mirror-inverted manner, wherein the two nominal current contact pieces and the two arcing contact pieces should preferably have rotationally symmetrical contact regions, which are displaceable relative to one another along the axis of rotation. A displaceability of any contact pieces of the two contact pieces makes it possible to adjust the first and subsequent contact establishment and contact separation respectively between arcing contact pieces and nominal current contact pieces in an optimized manner. By way of example it is thus possible to design the contact separation speed or contact speed of the nominal current contact pieces in a manner different from the contact speed or contact separation speed of the arcing contact pieces. It is also possible to move at least one arcing contact piece independently of a movement of the nominal current contact pieces into a dielectrically shielded position. By way of example the nominal current contact pieces can thus already come to a stop, whilst the arcing contact pieces each still perform a movement in order to be brought into a dielectrically shielded region.

In addition, a method should be specified, which serves to actuate a switching arrangement in order to safely extinguish high-power switching arcs.

In accordance with the invention an actuation method for switching a switching arrangement comprising a first contact set and a second contact set, which can be moved relative to the first contact set, is provided, wherein the switching arrangement has an insulating nozzle arrangement supported on the first contact set, and the first contact set has a first arcing contact piece, wherein, in the event of a switch-on procedure, the first and the second contact set are brought toward another, wherein a distance of the first arcing contact piece from the insulating nozzle arrangement is reduced.

The first and second contact set are contacted during a switch-on procedure. Here, the first arcing contact piece is used to contact a second arcing contact piece of the second contact set, wherein these contact one another first in the event of a switch-on procedure and then a first nominal current contact piece of the first contact set and a second nominal current contact piece of the second contact set contact one another. A rapid contacting of the arcing contact pieces is assisted by a movement of the first arcing contact piece relative to the insulating nozzle arrangement. Furthermore, the switching arrangement is prepared for a switch-off procedure already during a switch-on procedure, since the first arcing contact piece assumes a suitable position with respect to the insulating nozzle arrangement. Here, the distance of the first arcing contact piece is reduced, wherein a mouth opening of a nozzle channel of the insulating nozzle arrangement is brought toward the first arcing contact piece, in particular a mouth opening of a channel of the first arcing contact piece. Here, the first arcing contact piece may be surrounded by the insulating nozzle arrangement at least in portions on the outer circumferential side. The first arcing contact piece by way of example may plunge deeper into a recess in the insulating nozzle arrangement. The nozzle channel may lead into the recess.

In accordance with a further advantageous embodiment the first arcing contact piece may be moved out from a field shadow of a first nominal current contact piece following an initiation of a switching movement of the first contact set in the event of a switch-on procedure.

If the distance between the insulating nozzle arrangement and the first arcing contact piece assumes its intended smallest-possible value, the switching device arrangement is thus prepared for a switch-off procedure. The minimal distance sought at the start of a switch-off operation is already present between the insulating nozzle arrangement and the first arcing contact piece. The first arcing contact piece is for this purpose moved out from a field shadow of a dielectrically shielding arrangement, for example of a surrounding first nominal current contact piece. If the first contact set is moved, the first arcing contact piece thus advantageously remains in the shield region of the first nominal current contact piece of the first contact set. The first nominal current contact piece can be formed in a substantially tubular manner, for example, and may surround the first arcing contact piece. Here, a movement of the first arcing contact piece in order to leave the field shadow can be triggered already during the start of the movement of the first nominal current contact piece of the first contact set. The first arcing contact piece should leave the field shadow at the latest at the moment at which there is a risk of an undefined ignition of preliminary flashovers between the two contact sets moving toward one another.

Furthermore, in the event of a switch-off procedure, the distance between the first arcing contact piece and insulating nozzle arrangement advantageously can be enlarged before a switching arc is extinguished.

As a switching arc burns, only a low dielectric load is to be recorded in the region between the first arcing contact piece and insulating nozzle arrangement. With an extinguishing of a switching arc, potential differences occur between the contact sets. There is a risk of field strength superelevations in particular at the transition between the solid insulation of the insulating nozzle arrangement and the electrically insulating fluid. By increasing the distance between the insulating nozzle arrangement (or a mouth opening of the nozzle channel) and the first arcing contact piece (or a mouth opening of the channel thereof), an increased quantity of electrically insulating fluid can be introduced between the insulating nozzle arrangement and the first arcing contact piece. The insulation capability in the region of the mouth opening of the nozzle channel is thus increased.

In accordance with a further advantageous embodiment, the first contact set has a first arcing piece and a first nominal current contact piece, and the second contact set has a second arcing contact piece and a second nominal current contact piece, and each of the two arcing contact pieces and each of the two nominal current contact pieces perform switching movements driven by a common drive arrangement.

A favorable switching sequence of the electrical switching arrangement can be enforced by a driving of all arcing contact pieces and all nominal current contact pieces. If a common drive arrangement is now used in order to perform all switching movements, the individual movements of the arcing contact pieces and also of the nominal current contact pieces can be synchronized in a simple manner, starting from the common drive arrangement.

BRIEF DESCRIPTION OF THE SEVERAL VIEWS OF THE DRAWING

An exemplary embodiment of the invention will be shown hereinafter schematically in a drawing and described in greater detail further below. In the drawing

DESCRIPTION OF THE INVENTION

Figure 1:
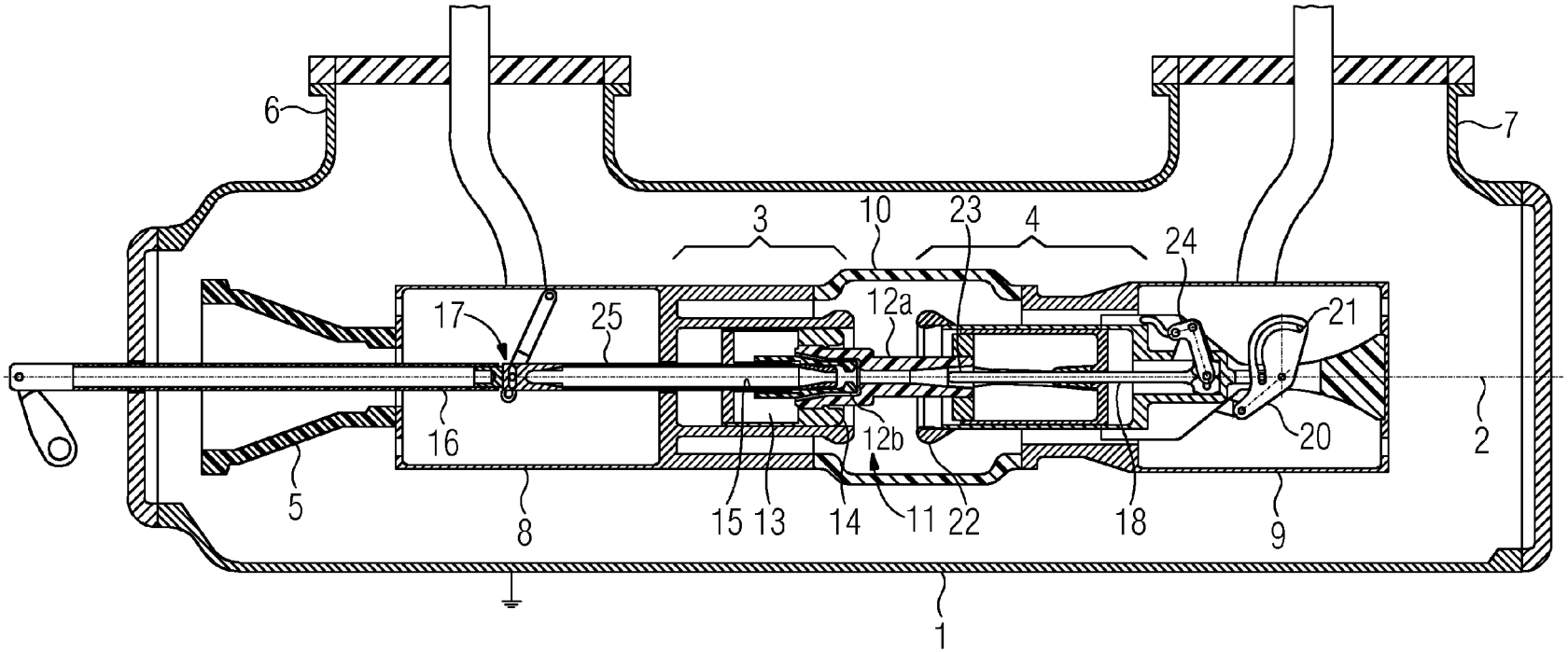
FIG. 1 shows an electrical switching arrangement in the switched-off state.

FIG. 1 shows a switching arrangement in section. The switching arrangement has an encapsulating housing 1. The encapsulating housing 1 is substantially tubular and is oriented coaxially with a longitudinal axis 2. The encapsulating housing 1 is fabricated for example from electrically conductive material and surrounds an interrupter unit arranged in the interior. The encapsulating housing 1 preferably conveys ground potential. The interrupter unit has a first contact set 3 and a second contact set 4. The interrupter unit is supported relative to the encapsulating housing 1 by means of electrically insulating support insulators. A support insulator 5 is illustrated in FIG. 1 by way of example. The encapsulating housing 1 has, on its outer circumference, a plurality of flange pieces 6, 7. The flange pieces 6, 7 are used for insertion of phase conductors into the interior of the encapsulating housing 1 so as to electrically contact the interrupter unit located there and to incorporate said unit into a current path to be interrupted. The phase conductors penetrate the flange supports 6, 7, arranged on the outer circumferential side, in an electrically insulated and fluid-tight manner. Disk-shaped insulators, which close the flange pieces 6, 7 in a fluid-tight manner, are arranged around the phase conductors in order to close the encapsulating housing 1 in a fluid-tight manner. Furthermore, end openings of the encapsulating housing 1 are closed by appropriate flange covers. The interior of the encapsulating housing 1 is filled with an electrically insulating fluid, for example sulfur hexafluoride gas or another electrically insulating gas. The electrically insulating fluid flushes over and flushes through the interrupter unit of the switching arrangement arranged in the interior of the encapsulating housing 1. The interrupter unit is oriented with its longitudinal axis in line with the longitudinal axis 2 of the encapsulating housing.

The interrupter unit has a first supporting body 8 and a second supporting body 9. The first supporting body 8 is used to position the first contact set 3. The second supporting body 9 is used to position the second contact set 4. The two supporting bodies 8, 9 are in the present case formed differently from one another. However, identical supporting bodies 8, 9 can also be used. The two supporting bodies 8, 9 are each formed as hollow bodies, which are substantially rotationally symmetrical, wherein the two supporting bodies 8, 9 comprise an electrically conductive material (for example a metal) and are electrically conductively contacted with the phase conductors guided through the flange pieces 6, 7 into the interior of the encapsulating housing 1. The supporting bodies 8, 9 thus form part of a current path which is to be interrupted by the switching arrangement. The two supporting bodies 8,9 are oriented with their axes of rotation coaxial with the longitudinal axis 2 and are arranged at a distance from one another, wherein end faces, facing toward one another, of the two supporting bodies 8, 9 are connected to one another at a fixed angle via an electrically insulating spacer 10. The spacer 10 is illustrated in FIG. 1 symbolically. The electrically insulating spacer 10 can surround the longitudinal axis 2 in closed form, for example in the manner of a pipe. However, the electrically insulating spacer 10 may also have a plurality of bars distributed over a circumference about the longitudinal axis 2, which bars connect the two supporting bodies 8, 9 to one another at a fixed angle in the manner of a cage.

The switching chamber 11 of the switching arrangement is arranged in the region of the electrically insulating spacer 10. An insulating nozzle arrangement 12 protrudes into the switching chamber 11. In the present case the insulating nozzle arrangement 12 has a main nozzle 12*a* and also an auxiliary nozzle 12*b*. The main nozzle 12*a* and also the auxiliary nozzle 12*b* jointly delimit a nozzle channel, which is oriented coaxially with the longitudinal axis 2. The main nozzle and auxiliary nozzle 12*a*, 12*b* are each rotationally symmetrical, wherein the auxiliary nozzle 12*b* protrudes into the main nozzle 12*a*. An annular channel is formed between the main nozzle 12*a* and the auxiliary nozzle 12*b*, which channel leads into the nozzle channel from the radial direction. The annular channel connects the nozzle channel to a heating volume 13. The insulating nozzle arrangement 12 is connected via its main nozzle 12*a* and its auxiliary nozzle 12*b* at a fixed angle to an axially displaceable first nominal current contact piece 14, which is positioned in the first supporting body 8. An axial movement of the first nominal current contact piece 14 in the direction of the longitudinal axis 2 is transmitted to the insulating nozzle arrangement 12, such that this is moved similarly to the first nominal current contact piece 14. The first nominal current contact piece 14 is contacted electrically conductively with the first supporting body 8 by means of sliding contact. Furthermore, the first contact set 3 has a first arcing contact piece 15. The first arcing contact piece 15 is tubular and is oriented coaxially with the longitudinal axis 2. At its end facing toward the nozzle channel of the insulating nozzle arrangement 12, the first arcing contact piece 15 has a contact socket for forming a contact region of the first arcing contact piece 15. The contact socket surrounds a mouth opening of a channel formed on the inner circumferential side on the tubular first arcing contact piece 15. The first arcing contact piece 15 is electrically conductively connected to the first supporting body 8 via a sliding contact arrangement. The first arcing contact piece 15 and also the first nominal current contact piece 14 thus always have the electric potential of the first supporting body 8. A drive rod 16 is coupled to the end of the first arcing contact piece 15 facing away from the nozzle channel of the insulating nozzle arrangement 12. The drive rod 16 is equipped for this purpose with a transverse pin, which is guided in a slot of a drive element 25 of the first nominal current contact piece 14 or the insulating nozzle arrangement 12. The drive rod 16 penetrates a wall of the encapsulating housing 1 in a fluid-tight manner. It is thus possible to transmit a movement produced outside the encapsulating housing 1 to the first contact set 3.

The mouth opening of the channel of the first arcing contact piece 15 is arranged at a distance from an end mouth opening of the nozzle channel of the insulating nozzle arrangement 12. The mouth opening of the nozzle channel lies in a recess of the insulating nozzle arrangement 12, into which the first arcing contact piece 15 protrudes. The first arcing contact piece 15 protrudes into the recess of the insulating nozzle arrangement irrespectively of the switching position of the switching device. A movement of the first nominal current contact piece 14 is also coupled in at the first arcing contact piece 14 via a reduction gear 17 (see FIG. 7). For this purpose the reduction gear 17 has a lever arrangement, which in the event of a switch-on procedure moves the first nominal current contact piece 14/the insulating nozzle arrangement 12 and moves the first arcing contact piece 15 at an increased speed. In the event of a switch-off procedure a movement of the first nominal current contact piece 14/the insulating nozzle arrangement 12 is performed as well as a movement of the first arcing contact piece 15 at an increased speed.

A movement of the first nominal current contact piece 14 is also transmitted to the insulating nozzle arrangement 12 on account of the coupling of the insulating nozzle arrangement 12 to the first nominal current contact piece 14 at a fixed angle. Here, the insulating nozzle arrangement 12 is contacted in the inner circumferential side against the first nominal current contact piece 14 and surrounds at least the contact region with the contact socket of the first arcing contact piece 15 on the outer circumferential side. Furthermore, a gap of variable dimension located between the mouth openings of the nozzle channel and of the channel of the first arcing contact piece 15 is surrounded by the insulating nozzle arrangement 12.

A connecting rod 18 of a slider crank gearing is struck in the region of the end mouth opening of the nozzle channel of the insulating nozzle arrangement 12, which faces away from the first arcing contact piece 15. The connecting rod 18 ends at a crank arm 20 mounted in a stationary manner on the second supporting body 9. The crank arm 20 is a pivoted lever and converts an axial movement of the insulating nozzle arrangement 12 into a rotary movement. A slotted guide path 21 is arranged in the crank arm 20, in which path a sweeping element is guided, which is connected to a linearly displaceable second nominal current contact piece 22. The second nominal current contact piece 22 is mounted axially displaceably on the second supporting body 9 and is electrically conductively connected to the second supporting body 9. The second nominal current contact piece 22 is formed as a hollow cylinder, wherein, coaxially with the second nominal current contact piece 22, a second arcing contact piece 23 is surrounded by the second nominal current contact piece 22. The second arcing contact piece 23 is mounted displaceably on the second nominal current contact piece 22. A supplemental movement can be coupled in at the second arcing contact piece 23 via a further gearing 24 during the course of a movement of the second nominal current contact piece 23, such that the movement profile of the moving second nominal current contact piece 22 forms the basis for a movement of the second arcing contact piece 23, wherein the movement profiles of the first nominal current contact piece 22 and of the second arcing contact piece 23 supplement one another, such that the second arcing contact piece 23 can be moved with respect to the second supporting body 9 at a greater speed than the second nominal current contact piece 22.

A relative movement of the first arcing contact piece 15 relative to the insulating nozzle arrangement 12 is ensured independently of the embodiment of the second contact set 4. By way of example, merely a drive of the first nominal current contact piece 14 and of the first arcing contact piece 15 may also be provided in order to generate a relative movement between the first and the second arcing contact piece 15, 23 and also between the first and the second nominal current contact piece 14, 22, wherein the second nominal current contact piece 22 and the second arcing contact piece 23 by way of example remain unchanged with respect to the second supporting body 9.

Figure 2:
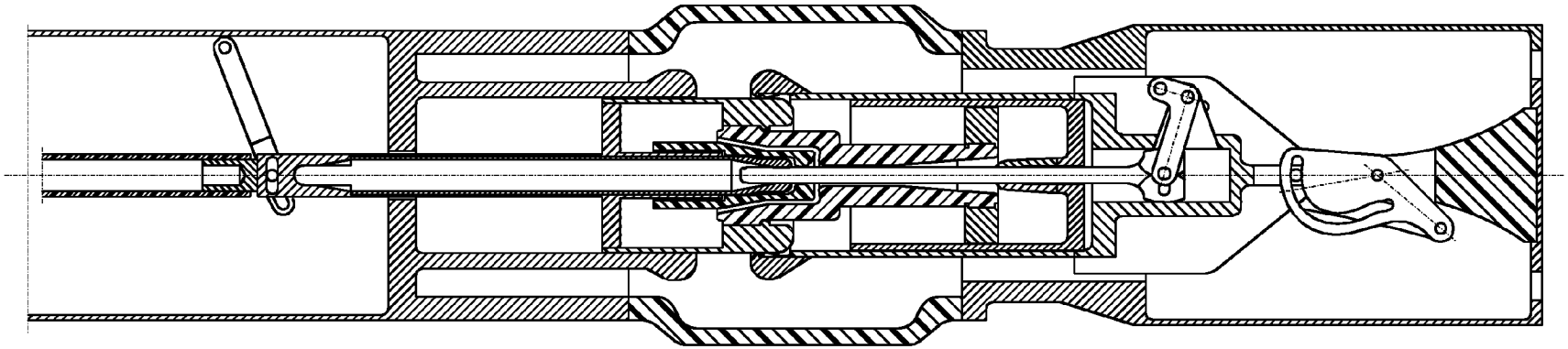
FIG. 2 shows an electrical switching arrangement in the switched-on state.
Figure 3:
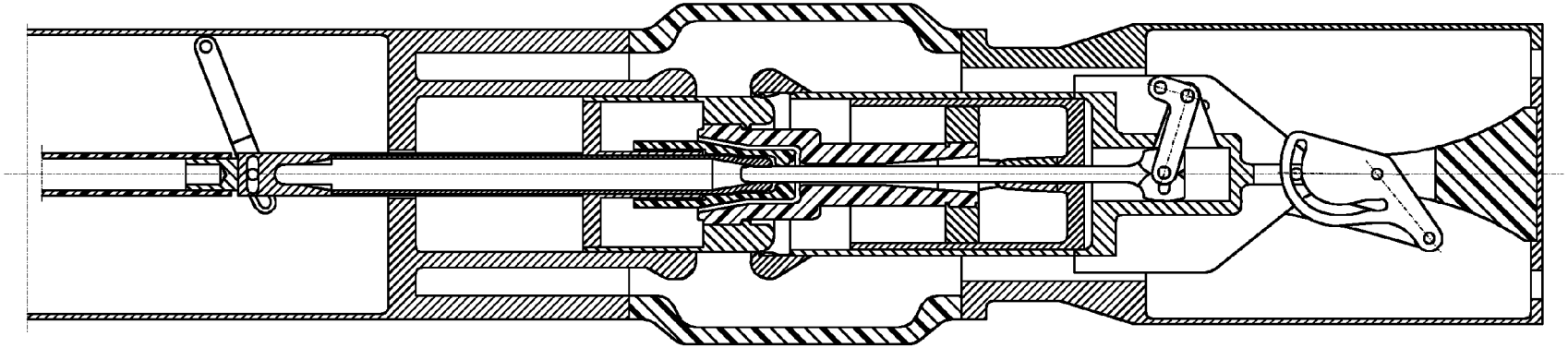
FIGS. 3 to 6 show a transition of the electrical switching arrangement from a switched-on state into a switched-off state.
Figure 4:
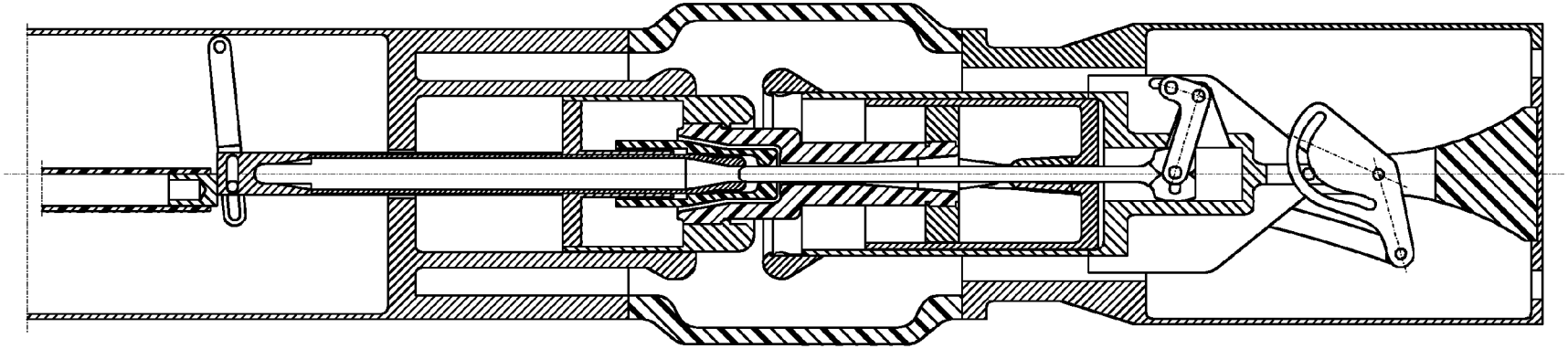
Figure 5:
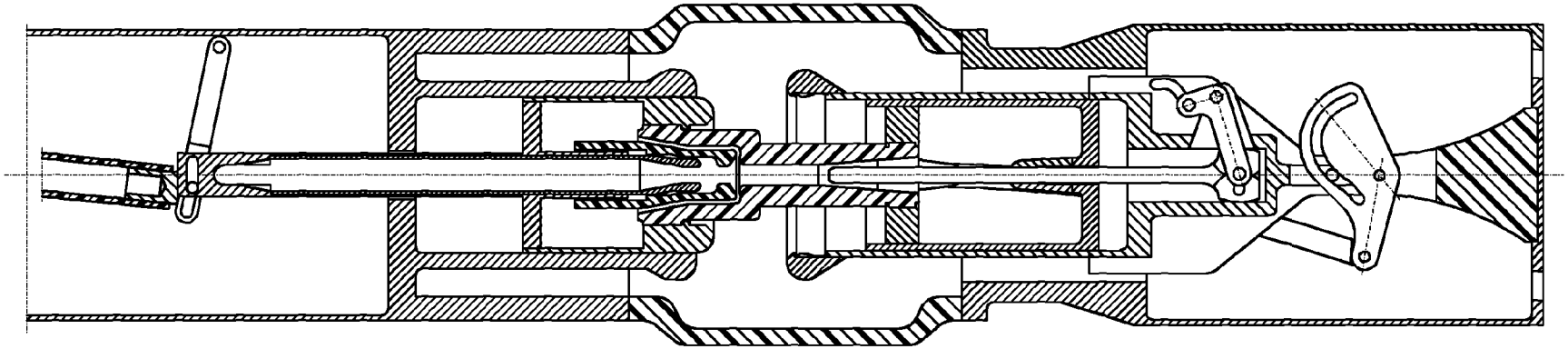
Figure 6:
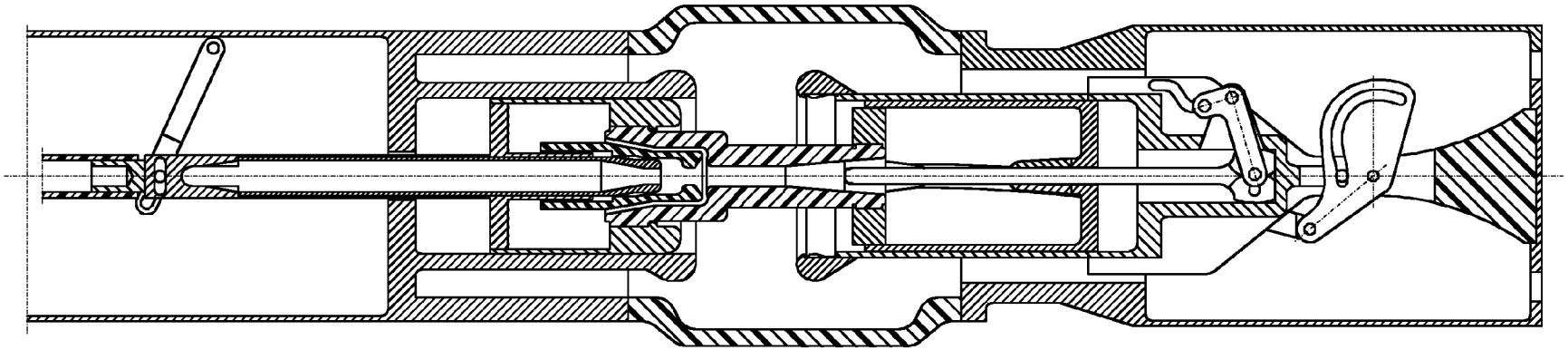

FIGS. 2, 3, 4, 5 and 6 illustrate a switching process for reaching the switched-off position proceeding from the switched-on position of the switching arrangement illustrated in FIG. 2, passing via FIGS. 3, 4 and 5. In particular it can be seen that in the switched-on state (FIG. 2) the distance of the mouth opening of the channel of the first arcing contact piece 15 from the end mouth opening of the nozzle channel of the insulating nozzle arrangement 12, which faces toward the first arcing contact piece 15, has the smallest value. At the start of a switch-off movement (FIG. 3), the first nominal current contact piece 14 and the first arcing contact piece 15 are first moved. The second nominal current contact piece 23 still remains unchanged, since the slotted guide path 21 of the crank arm 20 does not couple in any movement at the first nominal current contact piece 14 on account of the course of said path lying concentrically with the pivot point in this region. As a result, the second arcing contact piece 23, which is supported on the second nominal current contact piece 23, also remains unchanged. Following a separation of the first nominal current contact piece 14 from the second nominal current contact piece 23 (FIG. 4), a movement in the opposite direction is then transmitted to the second arcing contact piece 23. Subsequently (FIG. 5), both the first nominal current contact piece 14 and the second nominal current contact piece 22 and also the first arcing contact piece 15 and also the second arcing contact piece 23 are distanced from one another. Here, the first arcing contact piece 15 is removed from the region of the switching chamber 11 more quickly than the first nominal current contact piece 14 is removed from the switching chamber 11. The first arcing contact piece 15 is moved into the shield region of the first nominal current contact piece 14, whereby a distance of the first arcing contact piece 15 from the mouth opening of the nozzle channel of the insulating nozzle arrangement 12 facing toward the first arcing contact piece 15 is increased. A switch-off arc ignited following the contact separation of the two arcing contact pieces 15, 23 (change from FIG. 4 to FIG. 5) burns between the two arcing contact pieces 15, 23 and is guided within the nozzle channel of the insulating nozzle arrangement 12. The switching arc expands what is known as switching gas within the nozzle channel, said gas being able to escape via the end mouth opening of the nozzle channel, which opening faces toward the first arcing contact piece 15. The switching gas escaping from the nozzle channel of the insulating nozzle arrangement 12 enters the mouth opening of the channel of the first arcing contact piece 15. The first arcing contact piece 15 discharges the switching gas from the switching chamber. In addition, the radial annular channel formed between the main nozzle 12*a* and the auxiliary nozzle 12*b* is used to discharge switching gas from the region of the burning switching arc from the nozzle channel of the insulating nozzle arrangement 12. This switching gas is introduced into the hating volume 13. The expanded switching gas is compressed within the heating volume 13 on account of the thermal energy input. Said gas is thus prevented from escaping on account of the burning arc and the nozzle channel of the insulating nozzle arrangement 12 plugged by the second arcing contact piece 23.

Only following a pressure reduction (switching arc extinguishing) in the nozzle channel can the compressed switching gas flow back from the heating volume 13 and escape via the end mouth openings of the nozzle channel of the insulating nozzle arrangement 12. Here, the clearance between open contacts is flushed and dielectrically reinforced.

Figure 7:
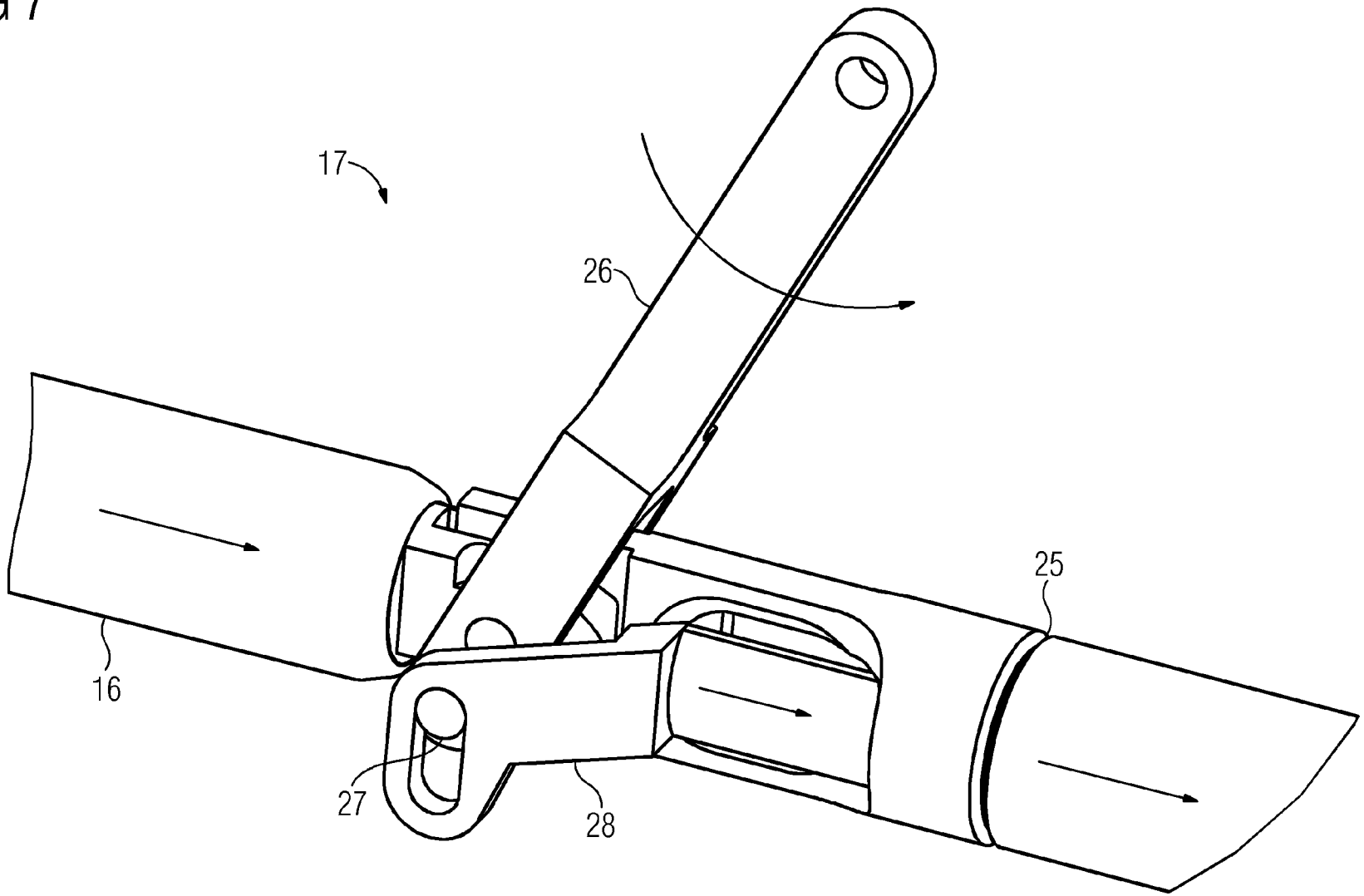
FIG. 7 shows a reduction gear for producing a relative movement between a first arcing contact piece and an insulating nozzle arrangement.

The reduction gear 17 is illustrated in detail in FIG. 7. The drive rod 16 is connected via a transverse pin to a drive element 25 of the first nominal current contact piece 14 or the insulating nozzle arrangement 12. For this purpose, the transverse pin engages with a slot in the drive element 25. It is thus possible, in the event of a linear movement of the drive rod 16, to couple in this linear movement directly at the first nominal current contact piece 14 or the insulating nozzle arrangement 12 via the flanks of the slot. The reduction gear 17 is also provided with a single-arm lever 26. The single-arm lever 26 is attached in a stationary manner to the first supporting body 8. The single-arm lever 26 is connected at the free end thereof to the transverse pin in the slot of the drive element 25. A coupling is thus provided via the single-arm lever 26 to the drive rod 16, which is linearly displaceable in order to transmit a movement. The single-arm lever 26 is pivoted in the event of a movement of the drive rod 16. In order to compensate for an overstroke of the single-arm lever 26, this slides through the slot of the drive element 25. Here, the resiliently deflectable drive rod 16 is moved out from its coaxial position in relation to the longitudinal axis 2 via the transverse pin in order to compensate for an overstroke of the single-arm lever 26. The single-arm lever 26 is also provided with a drive pin 27, wherein the distance of the drive pin 27 from the pivot point of the single-arm lever 26 is greater than the distance of the transverse pin from the pivot point of the single-arm lever 26. Accordingly, in the event of a pivoting of the single-arm lever 26, the drive pin 27 covers a greater path than the transverse pin, such that a movement at the drive pin 27 deviating from the movement of the transverse pin can be determined. A tab 28 strikes against the drive pin 27 and is connected to the linearly displaceable first arcing contact piece 15. In the present case the tab 28 is connected via a linearly displaceable thrust element, which is guided in the interior of the tubular drive element 25. The tab 28 is diverted in an elbowed manner through an opening in the outer circumferential side of the drive element 25 and is coupled to a slot on the drive pin 27. Here, the slot is directed in such a way that it is possible to compensate for an overstroke of the drive pin 27 located on the single-arm lever 26. Proceeding from the drive rod 16, a movement is thus transmitted onto the first nominal current contact piece 14 by the reduction gear 17, wherein a movement of increased speed is coupled in at the first arcing contact piece 15 with use of the single-arm lever 26 positioned in a stationary manner.

Figure 8:
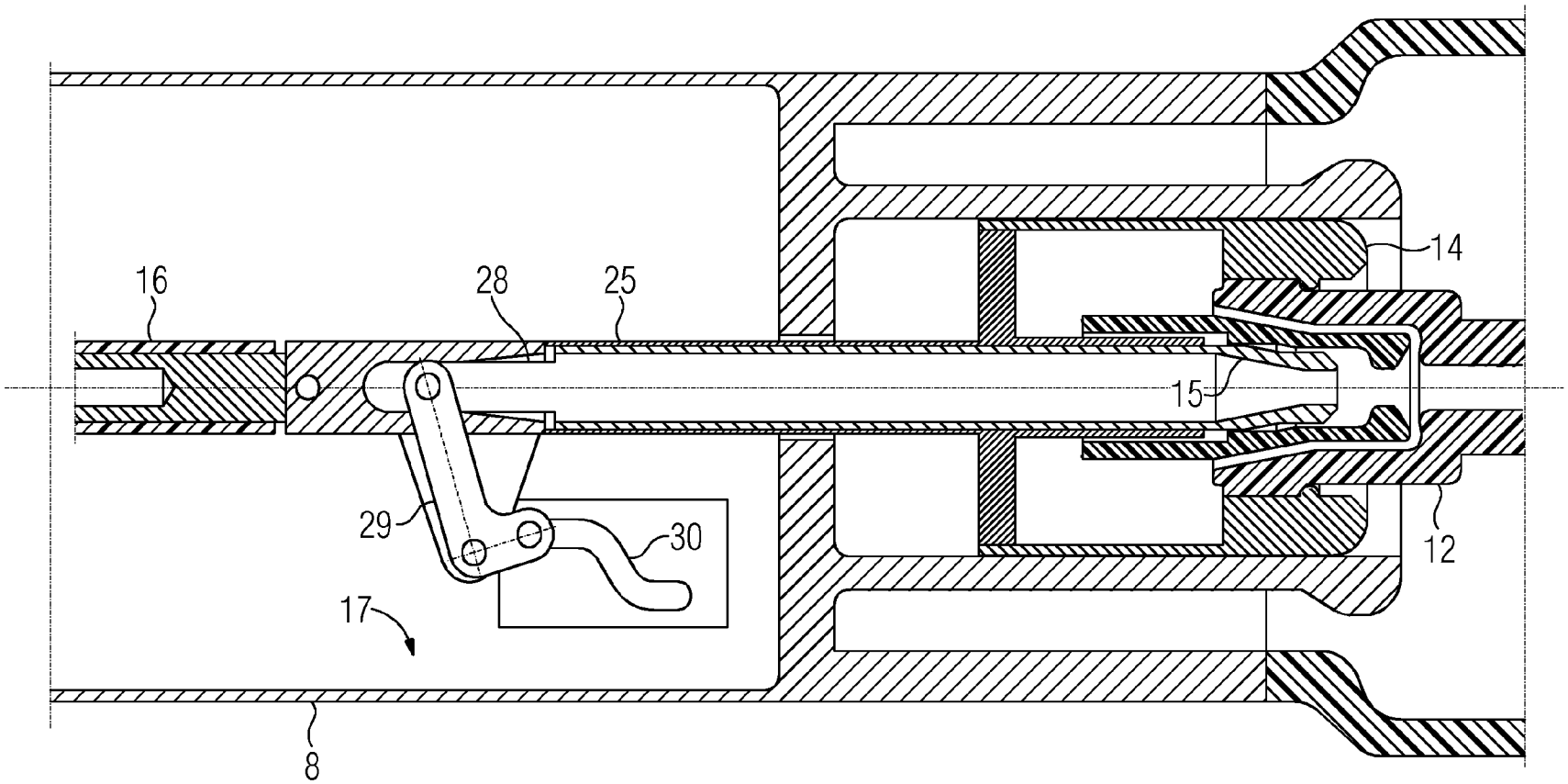
FIG. 8 shows an alternative reduction gear.

FIG. 8 shows an alternative reduction gear. A double-arm lever 29 is mounted rotatably on the drive element 25 there. The drive rod 16 is connected to the drive element 25, such that movements of the drive rod 16 are transmitted directly onto the drive element 25 and consequently also onto the first nominal current contact piece 14 and also the insulating nozzle arrangement 12.

The double-arm lever 29 is connected via one of its lever arms to a tab 28, which is guided in a linearly displaceable manner in the drive element 25 and transmits a movement onto the first arcing contact piece 15. In order to generate a movement of the first arcing contact piece 15 relative to the first nominal current contact piece 14, a slotted guide path 30 is positioned on the first supporting body 8. The other lever arm of the double-arm lever 29 sweeps through the slotted guide path 30, whilst the pivot point of the double-arm lever 29 is moved jointly with the drive element 25. On account of the shaping of the slotted guide path 30, an initiation or interruption of a transmission of a movement of the tab 28/of the first arcing contact piece 15 can be easily set. In the present case the end regions of the slotted guide path 30 are arranged parallel to the movement axis of the drive element 25. Thus, when passing the end regions, no additional movement is coupled in at the first arcing contact piece 15. The arcing contact piece 15 is moved jointly with the first nominal current contact piece 14 and the insulating nozzle arrangement 12 during the sweeping of the end regions. A central portion located between the end regions of the slotted guide path 30 has a gradient, such that an additional movement is coupled in here at the first arcing contact piece 15. Consequently, the distance of the mouth opening of the channel of the first arcing contact piece 15 from the facing mouth opening of the nozzle channel is reduced. The first arcing contact piece 15 also moves from the field shadow of the first nominal current contact piece 14. By varying the shaping of the slotted guide path 30, the movement profile of the first arcing contact piece 15 can be changed.

The invention claimed is:

1. A switching arrangement, comprising:

a first contact set;

a second contact set movably mounted relative to said first contact set;

an insulating nozzle arrangement supported on said first contact set, said insulating nozzle arrangement having a main nozzle and an auxiliary nozzle commonly delimiting a nozzle channel, with said main nozzle and said auxiliary nozzle each delimiting a portion of said nozzle channel; and said first contact set having an arcing contact piece movably mounted relative to said insulating nozzle arrangement enabling a relative movement between said first arcing contact piece and said insulating nozzle arrangement.

2. The switching arrangement according to claim 1, wherein said insulating nozzle arrangement delimits a nozzle channel formed with a mouth opening arranged opposite a mouth opening of a channel of said arcing contact piece.

3. The switching device arrangement according to 2, wherein said nozzle channel serves to convey a fluid medium, and fluid medium exiting from said mouth opening of said nozzle channel flows into said channel.

4. The switching device arrangement according to 2, wherein said arcing contact piece has a contact socket and said channel is surrounded, at least in portions, by said contact socket of said arcing contact piece.

5. The switching device arrangement according to 1, wherein said first contact set has a first nominal current contact piece carrying said insulating nozzle arrangement at least in part.

6. The switching device arrangement according to 5, wherein said first arcing contact piece is surrounded at least in portions by said first nominal current contact piece.

7. The switching device arrangement according to 5, wherein said first arcing contact piece and said first nominal current contact piece are movably mounted relative to one another.

8. The switching device arrangement according to 5, wherein said second contact set has a second nominal current contact piece and a second arcing contact piece, and wherein each of said first and second arcing contact pieces are movable in relation to each of said first and second nominal current contact pieces in order to generate a relative movement therebetween.

9. The switching device arrangement according to 1, wherein:

said first contact set has a first arcing piece and a first nominal current contact piece;

said second contact set has a second arcing contact piece and a second nominal current contact piece; and each of said first and second arcing contact pieces and each of said first and second nominal current contact pieces perform switching movements driven by a common drive arrangement.

10. An actuation method for switching a switching arrangement having a first contact set with a first arcing contact piece, a second contact set that is movable relative to the first contact set, and an insulating nozzle arrangement supported on the first contact set, the method which comprises:

on occasion of a switch-on procedure, moving the first contact set and the second contact set towards one another, and thereby reducing a spacing distance of the first arcing contact piece from the insulating nozzle arrangement by moving the first arcing contact piece relative to the insulating nozzle arrangement.

11. The actuation method according to 10, which comprises, for a switch-on procedure, following an initiation of a switching movement of the first contact set, moving the first arcing contact piece out from a field shadow of a first nominal current contact piece.

12. The actuation method according to 10, which comprises, for a switch-off procedure, enlarging a distance between the first arcing contact piece and the insulating nozzle arrangement before a switching arc is extinguished.

* * * * *